US005085830A

United States Patent [19]

Webster

[11] Patent Number: 5,085,830

[45] Date of Patent: Feb. 4, 1992

[54] PROCESS FOR MAKING ALUMINUM-LITHIUM ALLOYS OF HIGH TOUGHNESS

[75] Inventor: Donald Webster, Saratoga, Calif.

[73] Assignee: Comalco Aluminum Limited, Melboure, Australia

[21] Appl. No.: 328,364

[22] Filed: Mar. 24, 1989

[51] Int. Cl.[5] ..... C22C 1/02

[52] U.S. Cl. ..... 420/528; 75/678; 75/686; 420/533; 420/543

[58] Field of Search ..... 420/402, 407, 528, 529, 420/533, 542, 543, 545, 531, 532, 534, 535, 537, 540, 541-546, 549, 552, 553; 75/67, 68 R, 671, 678, 686

[56] References Cited

U.S. PATENT DOCUMENTS

| | | | |
|---|---|---|---|
| 1,620,082 | 3/1927 | Czochralski | 420/531 |
| 2,253,421 | 8/1941 | DeMare | 75/13 |
| 2,381,219 | 8/1945 | LeBaron | 75/139 |
| 2,915,391 | 12/1959 | Criner | 75/142 |
| 2,960,331 | 11/1960 | Hanks | 266/34 |
| 2,997,760 | 8/1961 | Hanks | 22/200.1 |
| 3,183,077 | 5/1965 | Kraus | 75/10 |
| 3,201,224 | 8/1965 | Grim | 75/13 |
| 3,288,601 | 11/1966 | Flemings et al. | 75/142 |
| 3,306,717 | 2/1967 | Lindstrand | 29/197 |
| 3,346,370 | 10/1967 | Jagaciak | 75/147 |
| 3,501,290 | 3/1970 | Finkl et al. | 75/12 |
| 3,546,348 | 12/1970 | DeCorso | 13/31 |
| 3,563,730 | 2/1971 | Bach | 148/12.4 |
| 3,563,813 | 2/1971 | Webster et al. | 148/12.4 |
| 3,708,279 | 1/1973 | DeCorso | 75/10 V |
| 3,720,508 | 3/1973 | Brock et al. | 75/147 |
| 3,741,827 | 6/1973 | Reynolds | 148/159 |
| 3,764,297 | 10/1973 | Coad et al. | 75/10 |
| 3,794,531 | 2/1974 | Markworth et al. | 148/159 |
| 3,873,378 | 3/1975 | Webster | 148/37 |
| 3,876,474 | 4/1975 | Watts et al. | 148/32 |
| 3,925,067 | 12/1975 | Sperry et al. | 75/142 |
| 3,984,260 | 10/1976 | Watts et al. | 148/32 |
| 4,033,794 | 7/1977 | Stowell et al. | 148/32 |
| 4,094,705 | 6/1978 | Sperry et al. | 148/2 |
| 4,164,434 | 8/1979 | Fister, Jr. et al. | 148/2 |
| 4,482,376 | 11/1984 | Tarasescu et al. | 75/10 R |
| 4,521,284 | 6/1985 | Tanabe et al. | 204/21 |

(List continued on next page.)

FOREIGN PATENT DOCUMENTS

| | | |
|---|---|---|
| 165317 | 11/1952 | Australia . |
| 863262 | 2/1971 | Canada . |
| 0150456 | 8/1985 | European Pat. Off. . |
| 296073 | 6/1988 | European Pat. Off. . |
| 377640 | of 1989 | European Pat. Off. . |
| 0150456 | 11/1990 | European Pat. Off. . |
| 3628276 | 2/1988 | Fed. Rep. of Germany . |
| 2561261 | 3/1984 | France . |
| 353891 | 7/1931 | United Kingdom . |
| 787665 | 12/1957 | United Kingdom . |
| 1172736 | 12/1969 | United Kingdom . |
| 1596917 | 9/1981 | United Kingdom . |
| 1596918 | 9/1981 | United Kingdom . |
| 2115836 | 9/1983 | United Kingdom . |
| 2121822 | 1/1984 | United Kingdom . |
| 2137227 | 10/1984 | United Kingdom . |

*Primary Examiner*—R. Dean
*Attorney, Agent, or Firm*—Kenyon & Kenyon

[57] ABSTRACT

The toughness of Al-Li, Al-Mg and Mg-Li alloys is increased by a melting and refining process designed to reduce the concentration of alkali metal impurities below about 1 ppm and preferably below about 0.1 ppm. The hydrogen and chlorine gas constituents are also significantly reduced.

14 Claims, 7 Drawing Sheets

U.S. PATENT DOCUMENTS

| | | | |
|---|---|---|---|
| 4,541,862 | 9/1985 | Finkl et al. | 75/12 |
| 4,584,173 | 4/1986 | Gray et al. | 420/533 |
| 4,588,553 | 5/1986 | Evans et al. | 420/533 |
| 4,594,222 | 6/1986 | Heck et al. | 420/529 |
| 4,597,792 | 7/1986 | Webster | 75/249 |
| 4,603,029 | 7/1986 | Ouist et al. | 420/535 |
| 4,624,717 | 11/1986 | Miller | 148/12.7 A |
| 4,626,409 | 12/1986 | Miller | 420/533 |
| 4,629,505 | 12/1986 | Paris | 75/228 |
| 4,661,172 | 4/1987 | Skinner et al. | 148/12.7 A |
| 4,717,068 | 1/1988 | Meyer | 228/203 |
| 4,735,773 | 4/1988 | Eckert | 420/528 |
| 4,735,774 | 4/1988 | Narayanan et al. | 420/533 |
| 4,747,884 | 5/1988 | Gayle et al. | 148/2 |
| 4,758,286 | 7/1988 | Dubost et al. | 148/12.7 |
| 4,761,266 | 8/1988 | Bruski | 420/528 |
| 4,772,342 | 9/1988 | Polmear | 148/418 |
| 4,777,998 | 10/1988 | Charbonnier | 164/259 |
| 4,786,337 | 11/1988 | Martin | 148/11.5 |
| 4,790,884 | 12/1988 | Young et al. | 148/2 |
| 4,793,854 | 12/1988 | Shimotori et al. | 75/10.10 |
| 4,799,976 | 1/1989 | Meyer | 148/203 |
| 4,802,656 | 2/1989 | Hudault et al. | 266/225 |
| 4,808,283 | 2/1989 | Toyoshima et al. | 204/71 |
| 4,816,087 | 3/1989 | Cho | 148/2 |
| 4,832,740 | 5/1989 | Meier | 75/68 R |
| 4,832,911 | 5/1989 | Dube et al. | 420/528 |
| 4,842,822 | 6/1989 | Colvin et al. | 420/533 |
| 4,919,187 | 4/1990 | Rupp et al. | 164/57.1 |

OTHER PUBLICATIONS

Howmet, "An Investment Cast Al-LI Alloy HTC 321" 3/1987.

Webster, "The Effect of Low Melting Point Impurities on the Properties of Aluminum-Lithium Alloys," Metallurgical Transactions A, vol. 18A, pp. 2181-2183, Jan. 1987.

Webster and Bennett, Touth(er) Aluminum-Lithium Alloys, Oct./1989.

Hayashi, Aging Phenomena of Al-Li-Mg Alloy Affected by Additional Elements, vol. 32, No. 7, Jul. 82.

Processing and Properties of 2091 and 8090 Forgings, D. Marchive and M. O. Charue, 4th International Aluminum Lithium Conference, 9/1987.

Development of an Experimental, Wrought Aluminum Alloy for Use at Elevated Temperature, I. J. Polmear, 1987.

Tem Investigation of Precipitates in Al-Cu-Mg-Ag and Al-Cu-Mg Alloys R. J. Chester and I. J. Polmear, 1980.

Effect of Lithium Addition on the Elevated Temperature Properties of 2219 Alloy, Kojima et al., Journal of Japan Institute of Light Metals, vol. 23, No. 11, Nov. 1986.

Factors Influencing Fracture Toughness and Other Properties of Aluminum-Lithium Alloys, Sanders, Jun., 1979.

Vaynblat, "Subbounday Embrittlement of the Alloy Al-Li-Mg by Horophile Impurity Sodium", 1976.

Starke et al., "New Approaches to Alloy Development in the Al-Li System", 8/81.

Watanabe "High Purity Al-Li Master Alloy by Molten Salt", 9/87.

Bretz "Alithalite Alloys: 1987 Update", Al-Li Symposium WESTEC '87, Mar. 25-26, 1987.

Webster "Factors Affecting the Tensile Strength, Elongation and Impact Resistance of Low Oxide, Isostatically Pressed Beryllium Block", 6/1976.

Wert, "Integranular Fracture in an Al-Li-Cu-Mg-Zr Alloy", vol. 19, 1985.

Vasudevan, "Contribution of Na-Segregation to Fraction Behavior of Al-11.4 at % Li Alloy", 1984.

PROCESS FOR MAKING ALUMINUM-LITHIUM ALLOYS OF HIGH TOUGHNESS

FIELD OF THE INVENTION

This invention relates to improving the physical properties of Al-Li, Al-Mg, and Mg-Li metallic products and more particularly to methods for increasing the toughness and ductility of such products without loss of strength.

BACKGROUND OF THE INVENTION

High strength aluminum alloys and composites are required in certain applications, notably the aircraft industry where combinations of high strength, high stiffness and low density are particularly important. High strength is generally achieved in aluminum alloys by combinations of copper, zinc and magnesium. High stiffness is generally achieved by metal matrix composites such as those formed by the addition of silicon carbide particles or whiskers to an aluminum matrix. Recently Al-Li alloys containing 2.0 to 2.8% Li have been developed. These alloys possess a lower density and a higher elastic modulus than conventional non-lithium containing alloys.

The preparation and properties of aluminum based alloys containing lithium are widely disclosed, notably in J. Stone & Company, British patent No. 787,665 (Dec. 11, 1957); Ger. Offen. 2,305,248 (National Research Institute for Metals, Tokyo, Jan. 24, 1974); Raclot, U.S. Pat. No. 3,343,948 (Sept. 26, 1967); and Peel et al., British Patent No. 2,115,836 (Sept. 14, 1983).

Unfortunately, high strength aluminum-lithium alloys are usually characterized by low toughness, as evidenced by impact tests on notched specimens (e.g., Charpy tests, See: Metals Handbook, 9th Ed. Vol 1, pages 689–691) and by fracture toughness tests on fatigue precracked specimens where critical stress intensity factors are determined.

There have been two basic techniques used to improve the toughness of Al-Li alloys.

1. Techniques commonly used for other aluminum alloys, such as alloying (Cu, Zn, Mg), stretching 1 to 5% before aging to refine precipitation, control of recrystallization and grain growth with Zr (0.1%) and the control of initial grain size by the use of powder metallurgy.

2. The production of dispersiods in amounts greater than needed for recrystallization control using 0.5 to 2% of Mn,Zr,Fe,Ti and Co to homogenize slip distribution.

In the last 10 years these methods have had some success but the toughness of Al-Li alloys still falls short of that of conventional aluminum alloys.

Conventional techniques, for improving the toughness of Al-Li alloys, have not included the use of a vacuum melting and refining treatment. Aluminum alloys which are typically melted in air; although, vacuum melting is used by some manufacturers of high quality aluminum investment castings, such as Howmet Turbine Components Corporation who make castings of A357 and A201, to avoid dross formation. (Bouse, G. K. and Behrendt, M. R. "Advanced Casting Technology Conference", edited by Easwaren, published by ASM, 1987).

Howmet has also made experimental Al-Li-Cu-Mg investment castings by vacuum melting (Proceedings of the Al-Li Alloys Conference, held in Los Angeles March, 1987, pp. 453–465, published by ASM International) to reduce reactions between lithium and air and to reduce hydrogen pick up which occurs when lithium reacts with moisture in the air. Commercial Al-Li alloys are usually melted under an argon atmosphere which accomplishes these objectives less efficiently than vacuum but is an improvement over air melting.

Al-Li alloys although having many desirable properties for structural applications such as lower density, increased stiffness and slower fatigue crack growth rate compared to conventional aluminum alloys are generally found to have the drawback of lower toughness at equivalent strength levels.

ADVANTAGES AND SUMMARY OF THE INVENTION

Advantages of the subject invention are that it provides a simple, versatile and inexpensive process for improving the toughness of Al-Li, Al-Mg and Mg-Al alloys that is effective on both virgin and scrap source alloys.

Another advantage of the subject invention is that it avoids formation and incorporation of various metal oxides and other impurities commonly associated with, e.g., powder metallurgy techniques, that involve heating and/or spraying the product alloy in air or other gases.

It has now been discovered that an improved combination of high strength, high toughness and good ductility can be obtained in aluminum alloys containing primary alloying elements selected from the group consisting of Li and Mg by processing the alloys in the molten state under conditions that reduce alkali metal impurities (AMI), i.e., (Na, K, Cs, Rb) content. The processing technique involves subjecting the molten alloy to conditions that remove alkali metal impurity, e.g., a reduced pressure for a sufficient time to reduce the concentration of each alkali metal impurity to less than about 1 ppm, preferably, less than about 0.1 ppm and most preferably less than 0.01 ppm.

As noted above the process also beneficially reduces the gas (hydrogen and chlorine) content of the alloys which is expected to provide an additional, improvement in quality by reducing the formation of surface blisters and giving superior environmentally controlled properties such as stress corrosion resistance. Preferably the hydrogen concentration is reduced to less than about 0.2 ppm, more preferably, less than about 0.1 ppm. Preferably the chlorine concentration is reduced to less than about 1.0 ppm more preferably less than about 0.5 ppm.

The alloys of this invention may be used to make high strength composite materials by dispersing particles such as fibers or whiskers of silicon carbide, graphite, carbon, aluminum oxide or boron carbide therein. The term aluminum based metallic product is sometimes used herein to refer generally to both the alloys and alloy composites of the invention.

The present invention also provides improved Mg-Li alloys, for example, the experimental alloy LA141A, comprising magnesium base metal, lithium primary alloying element and less than about 1 ppm, preferably less than about 0.1 ppm, and most preferably less than about 0.01 ppm of each alkali metal impurity selected from the group consisting of sodium, potassium, rubidium and cesium. As with the Al-Li and Al-Mg alloys described above the hydrogen concentration is preferably less than about 0.2 ppm, more preferably less than about 0.1 ppm and the chlorine concentration is preferably less than about 1.0 ppm, and more preferably less than about 0.5 ppm.

The Mg-Li alloys typically include about 13.0 to 15.0 percent lithium and about 1.0 to 1.5% aluminum preferably about 14.0%, lithium and about 1.25% aluminum. The Mg-Li of this invention can be made by the process described above in connection with the Al-Li and Al-Mg alloys.

DETAILED DESCRIPTION OF THE INVENTION

Figure 1:
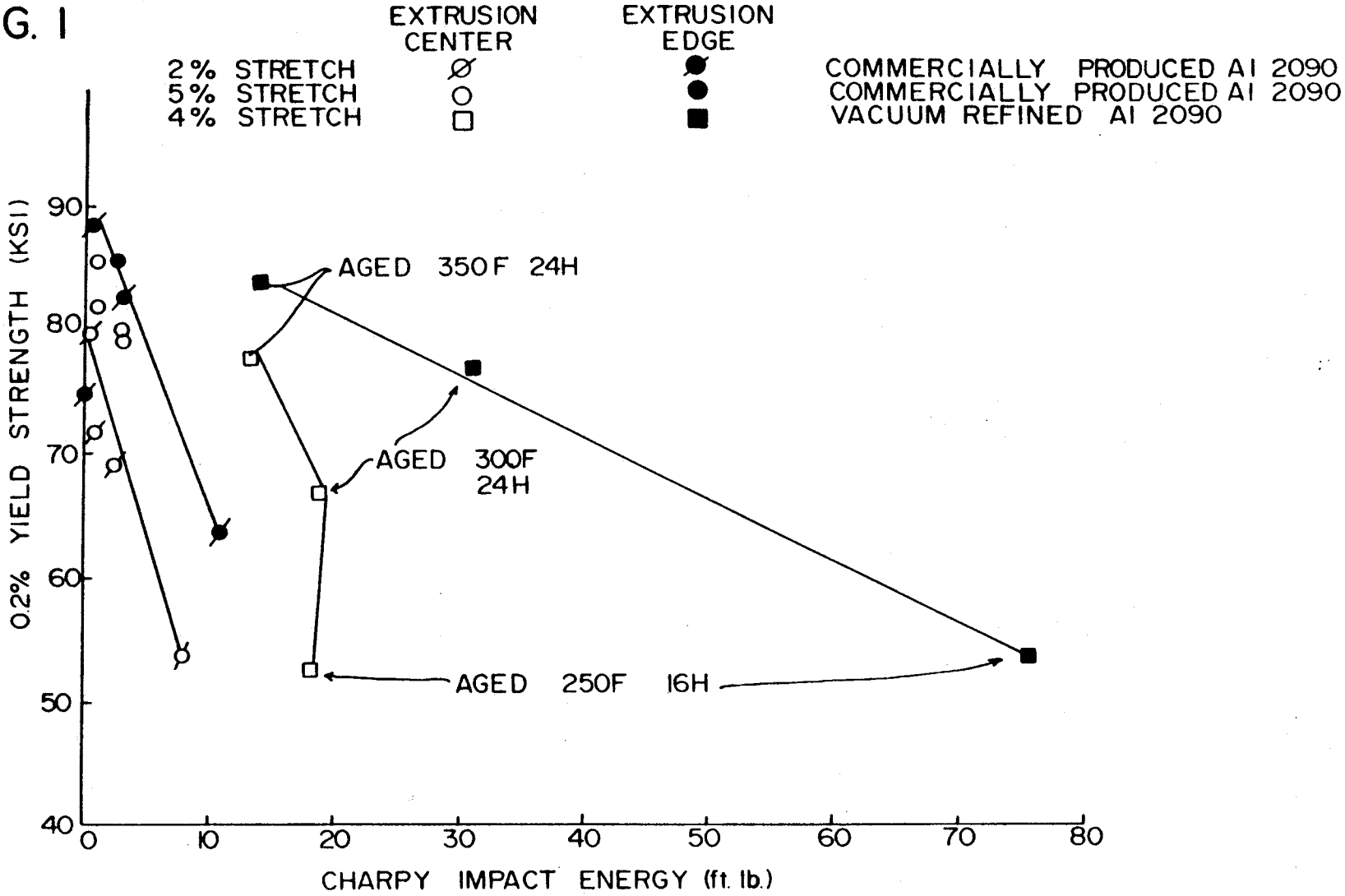
FIG. 1 is a plot of 0.2% tensile yield strength versus the Charpy impact energy at each strength level from a commercially produced A12090 alloy and a vacuum refined A12090 alloy produced by the process described herein. Property measurements are taken from both the center one third of the extrusion and the outer one third of each extrusion.

The present invention is applicable to aluminum based metallic materials containing lithium or magnesium as a primary alloying element and magnesium base of metallic materials including lithium, including both alloys and composites. The term 'primary alloying element' as used herein means lithium or magnesium in amounts no less than about 0.5%, preferably no less 1.0% by weight of the alloy. These materials can have a wide range of composition and can contain in addition to lithium or magnesium any or all of the following elements: copper, magnesium or zinc as primary alloying elements. All percents (%) used herein mean weight % unless otherwise stated.

Examples of high strength composites to which the present invention is also applicable include a wide range of products wherein Al-Li, Al-Mg and Mg-Li matrices are reinforced with particles, such as whiskers or fibers, of various materials having a high strength or modulus. Examples of such reinforcing phases include boron fibers, whiskers and particles; silicon carbide whiskers and particles, carbon and graphite whiskers and particles and, aluminum oxide whiskers and particles.

Examples of metal matrix composites to which the present invention is applicable also include those made by ingot metallurgy where lithium and magnesium are important alloying elements added for any or all of the following benefits, lower density, higher stiffness or improved bonding between the matrix and the ceramic reinforcement or improved weldability. The benefits conferred by the present invention on Al-Li, Al-Mg and Mg-Li composite materials are similar to those conferred to the corresponding alloys themselves, particularly, a combination of improved properties including higher toughness and ductility. Modern commercial Al-Li and Al-Mg alloys generally have a total (AMI) content of less than about 10 ppm which is introduced as impurity in the raw materials used for making the alloys. Mg-Li alloys also have high AMI contents corresponding to the larger proportions of/lithium used therein.

Typically, a major portion of AMI contamination comes from the lithium metal which often contains about 50 to 100 ppm of both sodium and potassium. Since Al-Li alloys usually contain about 2 to 2.8% Li the amount of sodium or potassium contributed by the lithium metal is usually in the range about 1 to 2.8 ppm. Additional AMI can be introduced through chemical attack by the Al-Li on the refractories used in the melting and casting processes. Therefore a total AMI content of about 5 ppm would not be unusual in commercial Al-Li ingots and mill products. AMI exist in Al-Li alloys as grain boundary liquid phases (Webster, D. met. Trans.A, Vol. 18A, December 1987, pp. 2181-2193.) which are liquid at room temperature and can exist as liquids to at least the ternary eutectic of the Na-K-Cs system at 195° K. (−78° C.). These liquid phases promote grain boundary fracture and reduce toughness. An estimate of the loss of toughness can be obtained by testing at 195° K. or below where all the liquid phases present at room temperature have solidified. When this is done the toughness as measured by a notched Charpy impact test has been found to increase by up to four times.

The present invention exploits the fact that all the AMI have higher vapor pressures and lower boiling points than either aluminum, lithium, magnesium or the common alloying elements such as Cu,Zn,Zr,Cr,Mn and Si. This means that the AMI will be removed preferentially from alloys including these and similar elements when the alloys are maintained in the molten state under reduced pressure for a sufficient time. The first impurities to evaporate will be Rb and Cs followed by K with Na being the last to be removed. The rate of removal of the AMI from the molten Al-Li bath will depend on several factors including the pressure in the chamber, the initial impurity content, the surface area to volume ratio of the molten aluminum and the degree of stirring induced in the molten metal by the induction heating system.

In a preferred embodiment, an increase in the AMI evaporation rate may be obtained by purging the melt with an inert gas such as argon introduced into the bottom of the crucible through a refractory metal (Ti,-Mo,Ta) or ceramic lance. The increase in removal rate due to the lance will depend on its design and can be expected to be higher as the bubble size is reduced and the gas flow rate is increased. The theoretical kinetics of the refining operation described above can be calculated for a given melting and refining situation using the principles of physical chemistry as for example those summarized in the Metals Handbook Vol. 15, Casting, published in 1988 by ASM International.

The refining process is preferably carried out in a vacuum induction melting furnace to obtain maximum melt purity. However, in order to incorporate this technique into commercial Al-Li, Al-Mg and Mg-Li alloy production practice, the refining operation can take place in any container placed between the initial melting furnace/crucible and the casting unit, in which molten alloys can be maintained at the required temperature under reduced pressure for a sufficient time to reduce the AMI to a level at which their influence on mechanical properties particularly toughness is significantly reduced.

The process of the present invention may be operated at any elevated temperature sufficient to melt the aluminum base metal and all of the alloying elements, but should not exceed the temperature at which desired alloy elements are boiled-off. Useful refining temperatures are in the range of about 50° to 200° C., preferably about 100° C., above the melting point of the alloy being refined. The optimum refining temperature will vary with the pressure (vacuum), size of the melt and other process variables.

The processing pressure (vacuum) employed in the process to reduce the AMI concentration to about 1 ppm or less, i.e., refining pressure, is also dependent upon process variables including the size of the melt and furnace, agitation, etc. A useful refining pressure for the equipment used in the Examples hereof was less than about 200 μm Hg.

The processing times, i.e., the period of time the melt is kept at refining temperatures, employed in the process to reduce the AMI concentration to about 1 ppm or less are dependent upon a variety of factors including the size of the furnace, and melt, melt temperature, agitation and the like. It should be understood that agitation with an inert gas as disclosed herein will significantly reduce processing times. Useful processing times for the equipment used in the Examples herein ranged from about 40 to 100 minutes.

It should be understood that the temperature, time and pressure variables for a given process are dependent upon one another to some extent, e.g., lower pressures or longer processing times may enable lower temperatures. Optimum time, temperature and pressure for a given process can be determined empirically.

The following examples are offered for purposes of illustration and are not intended to either define or limit the invention in any manner.

EXAMPLE ONE

An A12090 alloy made by standard commercial practice was vacuum induction melted and brought to a temperature of about 768° C. under a reduced pressure of about 200 μm Hg. A titanium tube with small holes drilled in the bottom four inches of the tube was inserted into the lower portion of the molten metal bath and argon gas passed through the tube for five minutes. The gas was released well below the surface of the melt and then bubbled to the surface. The melt was then given a further refining period of about fifty minutes using only the reduced pressure of the vacuum chamber to reduce the AMI. The melt was grain refined and cast using standard procedures.

Five inch diameter billets were extruded into a flat bar 1.77 inches by 0.612 inches thick. The composition of the original melt and the vacuum remelted material are given in Table 1.

TABLE 1

CHEMIAL ANALYSES OF MATERIAL BEFORE AND AFER VACUUM REFINING

| ELEMENT | Al 2090 | Al 2090 VACUUM REFINED | ANALYSIS TECHNIQUE | ANALYSIS UNITS |
|---|---|---|---|---|
| Li | 1.98 | 1.96 | ICP | Wt. Pct. |
| Cu | 2.3 | 2.4 | ICP | Wt. Pct. |
| Zr | 0.13 | 0.13 | ICP | Wt. Pct. |
| Na | 3.2 | N.D. | ES | PPM |
| Na | 3.1 | 0.480 | GDMS | PPM |
| Na | ≠ | 0.480* | SIMS | PPM |
| K | 0.600 | 0.050 | GDMS | PPM |
| K | ≠ | 0.008 | SIMS | PPM |
| Cs | <0.008 | <0.008 | GDMS | PPM |
| Cs | ≠ | 0.015 | SIMS | PPM |
| Rb | 0.042 | <0.013 | GDMS | PPM |
| Rb | ≠ | .0005 | SIMS | PPM |
| Cl | 3.5 | 0.500 | GDMS | PPM |
| H (bulk) | 1.0 | 0.140 | LECO | PPM |

*SIMS analyses were standardized using GDMS and ES results.
PPM = parts per million
GDMS = glow discharge mass spectrometry
SIMS = secondary ion mass spectrometry
ES = emission spectrometry
LECO = hydrogen analysis by LECO Corporation, 3000 Lakeview Ave. St. Joseph, Mi, 49085 USA - melting alloy under a stream of nitrogen gas and determining the hydrogen content by change in thermal conductivity.
≠ = not determined It can be seen that the desirable alloying element concentrations, i.e., Li, Cu and Zr, were substantially unchanged during the vacuum melting and refining process, but the undesirable impurities, Na,K,Rb,H and Cl were markedly reduced. Since Cs was already below the detection limit of GDMS before the refining process began, no change in this element could be detected.

The Charpy impact toughness values of specimens produced from flat bar extrusions of the vacuum refined A12090 and specimens produced form a commercial A12090 alloy are compared as a function of 0.2% yield strength in FIG. 1. The strength-toughness combinations for the vacuum refined alloy surpass those of the commercial alloy at all strength levels and also exceeds these property combinations of the usually superior conventional alloys, A17075 and A12024 (not shown).

EXAMPLE TWO

Figure 2:
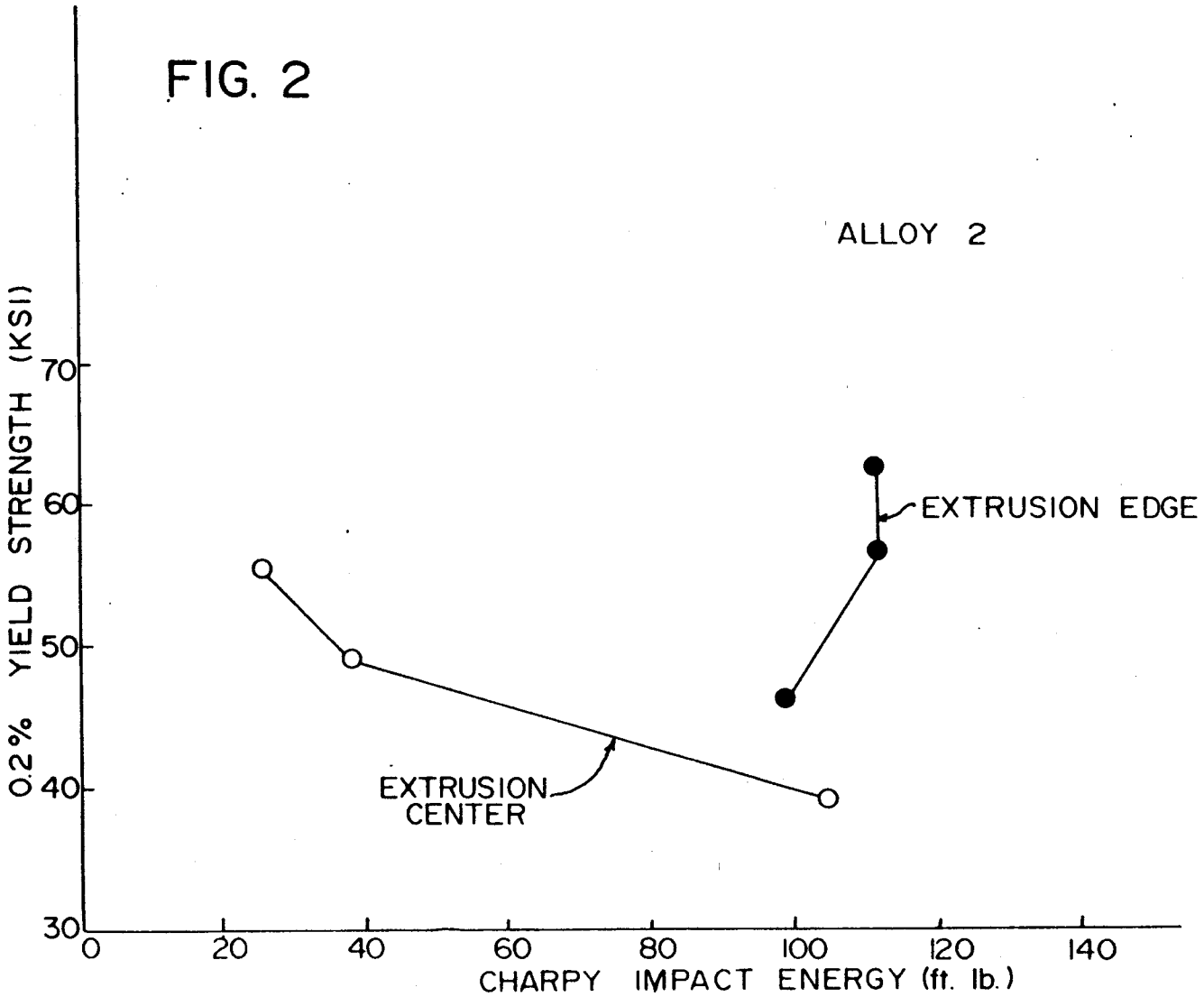
FIG. 2 is a plot of the 0.2% tensile yield strength versus the Charpy impact energy at each strength level for alloy 2 described in Example 2 and produced by the vacuum refining process described herein.

An alloy containing 1.8% Li, 1.14% Cu, 0.76% Mg and 0.08% Zr, was given a vacuum refining treatment similar to that in Example 1 except that an argon lance was not used. It was then cast and extruded to flat bar and heat treated in the same manner as described in Example 1. The toughness properties (FIG. 2) again greatly exceed those of commercial Al-Li alloys at all strength levels. In many cases the toughness exceeds 100 ft. lbs. and is higher than that for most steels.

EXAMPLE THREE

Figure 3:
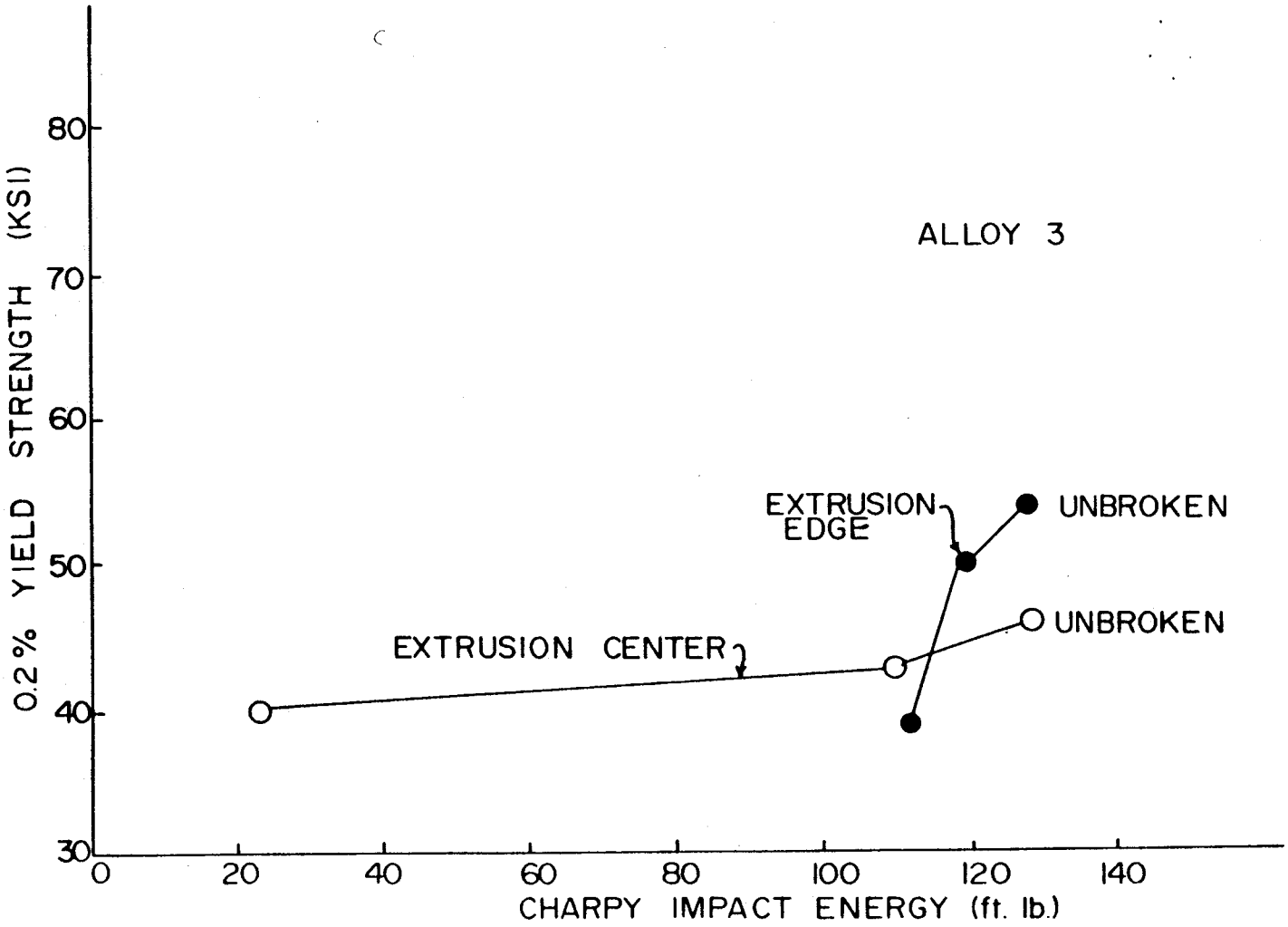
FIG. 3 is a plot of the 0.2% tensile yield strength versus the Charpy impact energy at each strength level for alloy 3 described in Example 3 and produced by the vacuum refining process described herein.

An alloy containing 2.02% Li, 1.78% Mg, and 0.08% Zr was given a vacuum refining treatment similar to that described in Example 2. It was then extruded and heat treated and its strength and toughness were evaluated and are illustrated in FIG. 3. This specimen was so tough that it could not be broken on the 128 ft. lb. Charpy testing machine capable of breaking specimens from almost all steel alloys.

EXAMPLE FOUR

Figure 4:
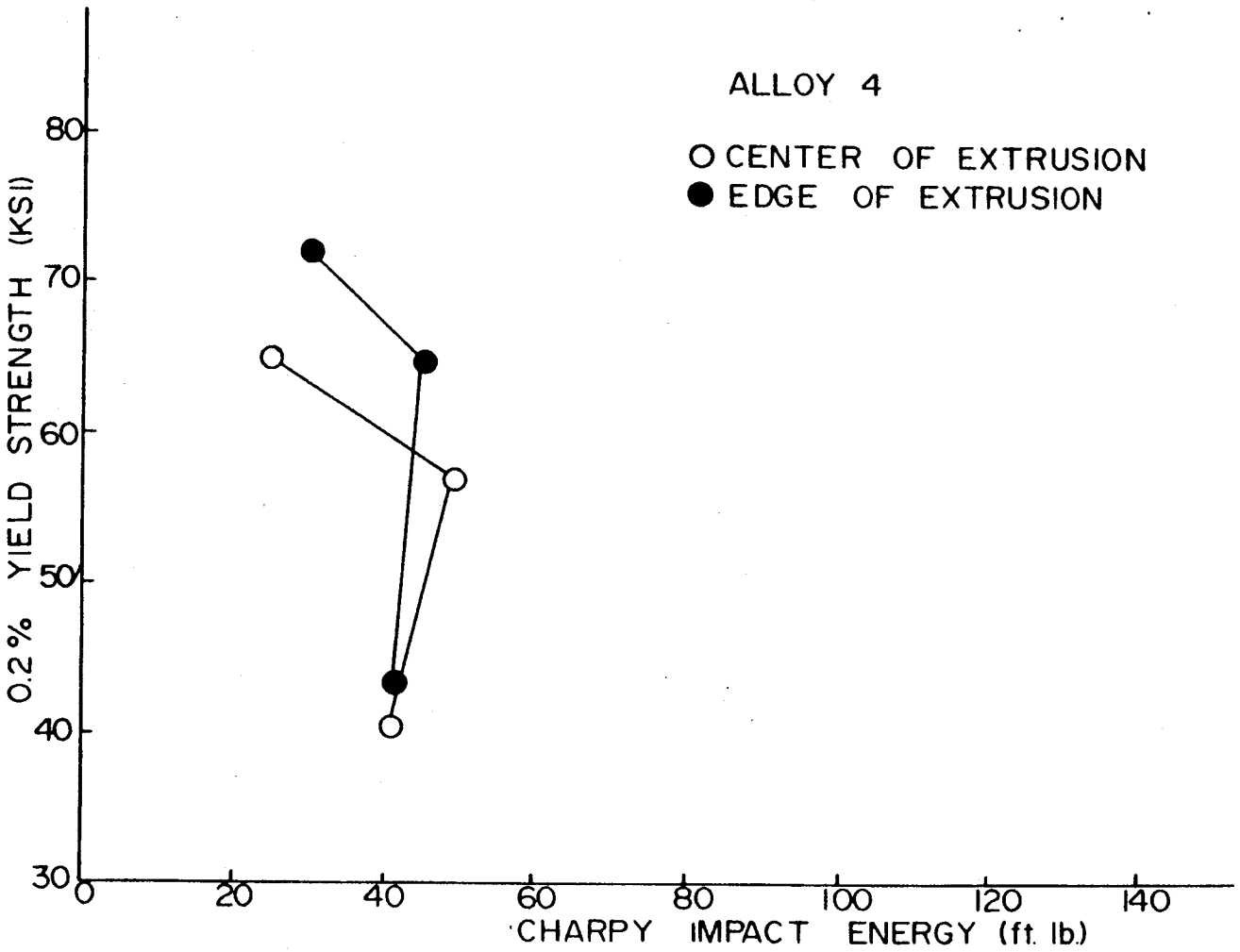
FIG. 4 is a plot of the 0.2% tensile yield strength versus the Charpy impact energy at each strength level for alloy 4 described in Example 4 and produced by the vacuum refining process described herein.

An alloy containing 2.4% Li, 0.88% Mg, 0.33% Cu and 0.18% Cr was given a vacuum refining treatment similar to that in Example 2. It was then extruded and heat treated and its strength and toughness were evaluated as in previous Examples and illustrated in FIG. 4. Again strength-toughness combinations greatly superior to those of conventional alloys were obtained.

EXAMPLE FIVE

Figure 5:
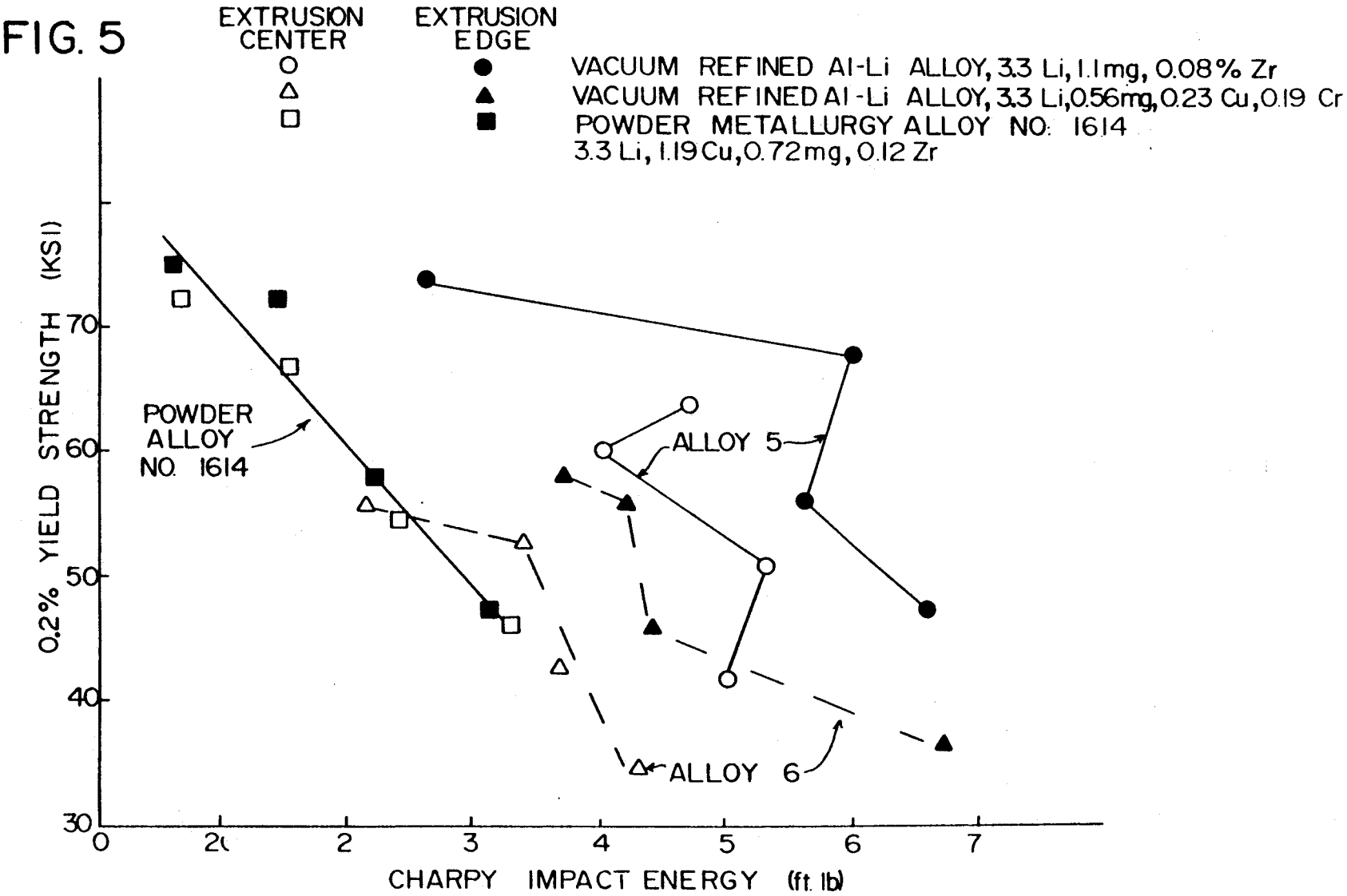
FIG. 5 is a plot of the 0.2% tensile yield strength versus the Charpy impact energy at each strength level for three alloys containing 3.3% Li and other alloying elements. Alloys 5 and 6 described in Example 5 were produced by the vacuum refining process described herein while alloy 1614 was produced by a powder metallurgy process and described in U.S. Pat. No. 4,597,792 and Met. Trans. A, Vol. 19A, March 1986, pp 603-615.

Two alloys (alloys 5 and 6) containing a higher than normal Li level (3.3% by weight) to obtain a very low density (0.088 lb/cu. in.) were given a vacuum refining treatment similar to that described in Example 2. The alloys were then cast, extruded and heat treated as in the previous examples. The strength-toughness combinations were evaluated and are shown in FIG. 5.

The high lithium level reduces the toughness compared to the alloys in Examples 1 to 4 but the properties are generally comparable to those of commercial Al-Li alloys and are superior to those of the much more expensive powder metallurgy alloys (U.S. Pat. No. 4,597,792 issued 1986 to Webster, D.) with the same lithium content as illustrated in FIG. 5. The compositions of the vacuum refined alloys described this example are:

Alloy 5.—3.3% Li, 1.1% Mg, 0.08% Zr

Alloy 6.—3.3% Li, 0.56% Mg, 0.23% Cu, 0.19% Cr

EXAMPLE 6

Figure 6:
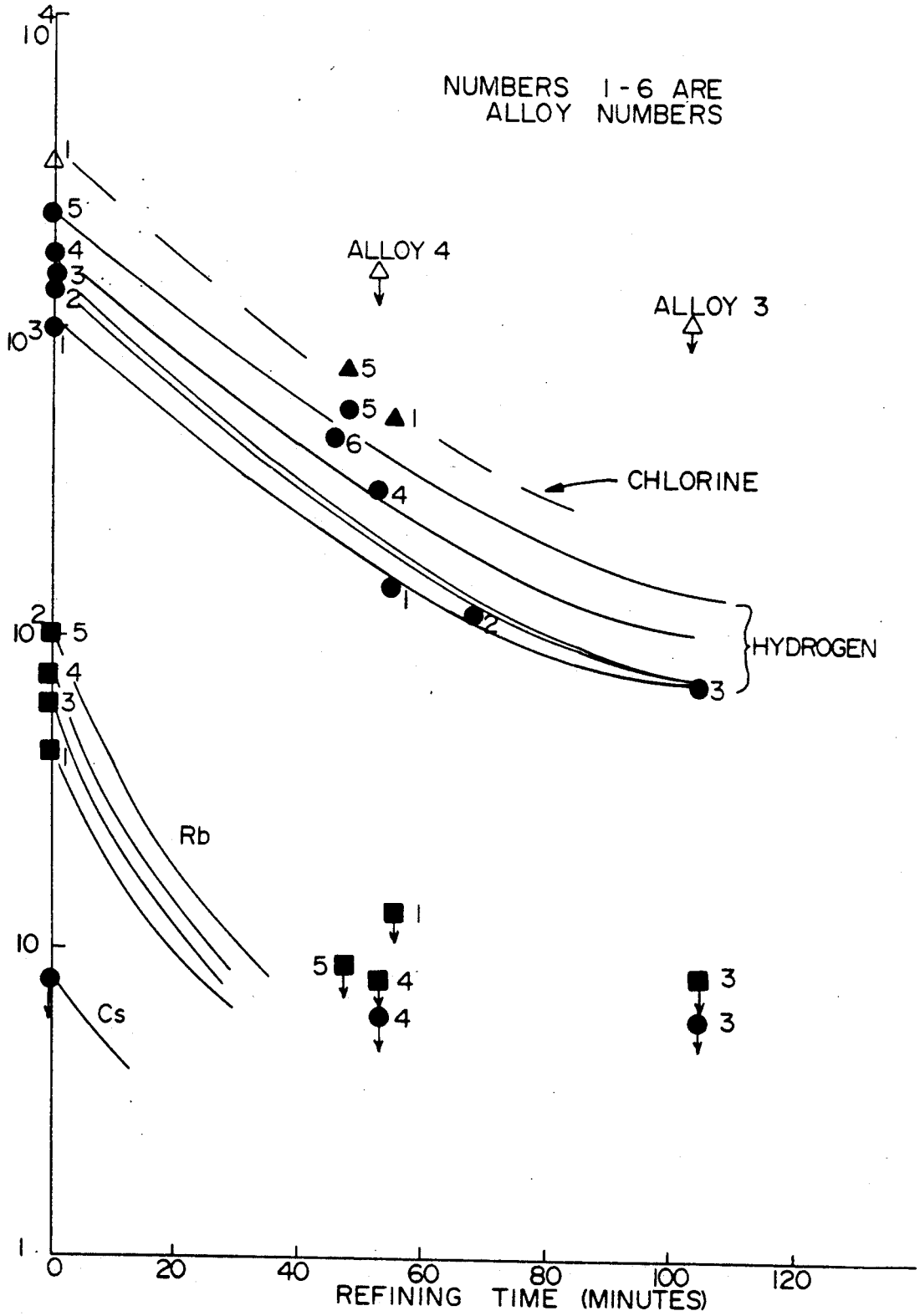
FIG. 6 is a plot of the concentration of H, Cl, Rb and Cs versus refining time for alloys 1 to 6.
Figure 7:
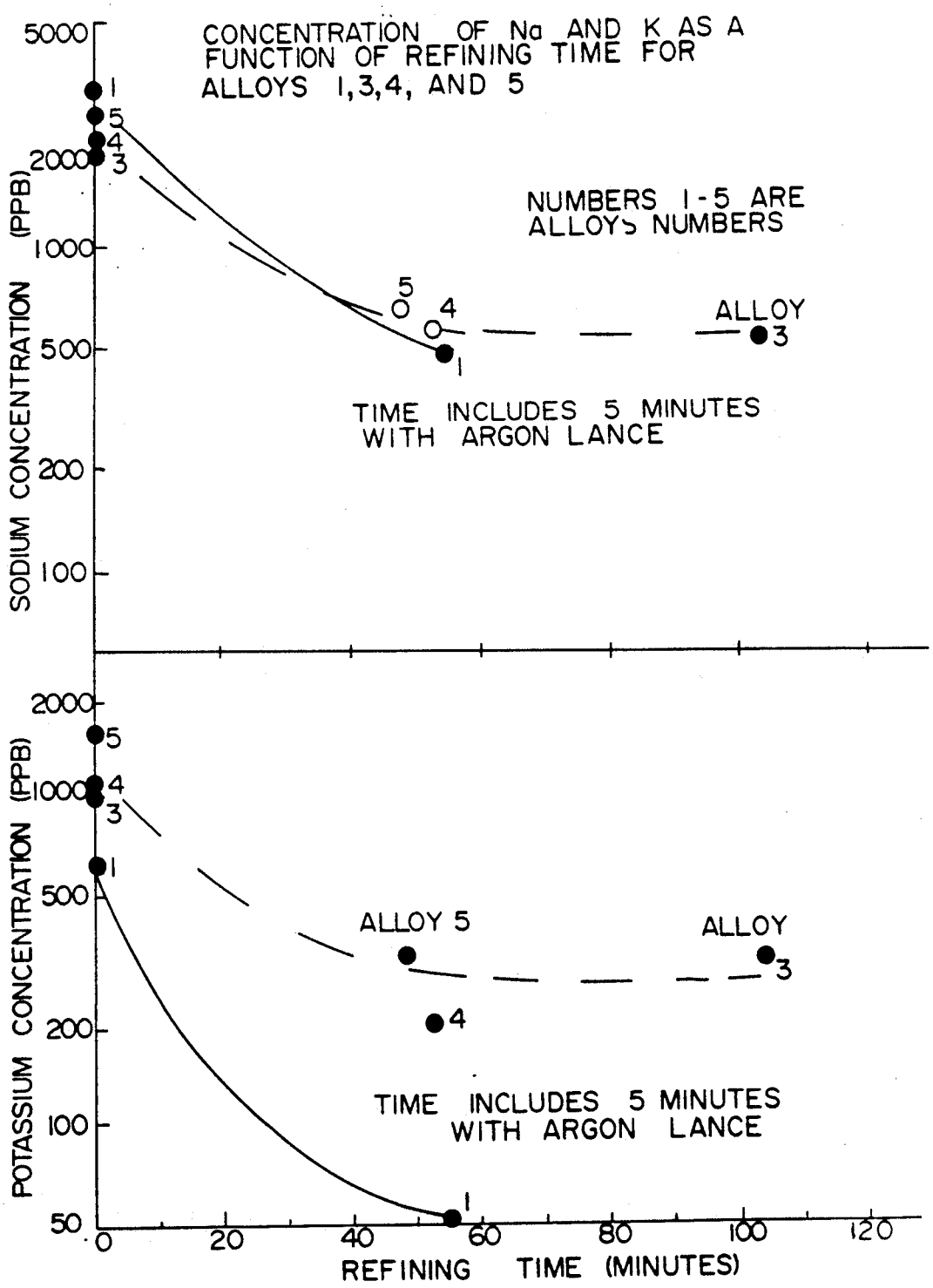
FIG. 7 is a plot of Na and K concentration versus refining time for alloys 1, 3, 4 and 5.

The above-described alloys 1 to 6 were analyzed for AMI concentration after refining steps of varying duration. The results of those analyses are summarized in Table II below and illustrated in FIGS. 6 and 7. It should be noted that the inert gas lance described above was only used for refining alloy 1, Example 1 which had the lowest final K and Na concentrations.

TABLE II

| | CHEMICAL COMPOSITION AS A FUNCTION OF REFINING TIME | | | | | | |
|---|---|---|---|---|---|---|---|
| | IMPURITY CONCENTRATION (PPB) | | | | | | REFINING TIME |
| ALLOY | Na | K | Rb | Cs | H | Cl | (Minutes) |
| 1- start* | 3100 | 600 | 42 | <8 | 1000 | 3500 | |
| finish | 480 | 50 | <13 | <8 | 140 | 500 | 55 |
| 2- start | | | | | 1350 | | |
| finish | | | | | 120 | | 68 |
| 3- start | 2000 | 1000 | 60 | 5 | 1420 | | |
| finish | 545 | 325 | <8 | <6 | 70 | 1044 | 104 |
| 4- start | 2200 | 1200 | 72 | 6 | 1700 | | |
| finish | 602 | 206 | <8 | <6 | 300 | 1540 | 53 |
| 5- start | 2650 | 1650 | 100 | 8 | 2300 | | |
| finish | 645 | 341 | <9 | <6 | 540 | 755 | 48 |
| 6- start | | | | | 3500 | | |
| finish | | | | | 420 | | 46 |

*The start values are based on data published in Webster, D. Met. Trans. A, Vol. 18A, Dec. 1987 pp 2181-2183.

What is claimed is:

1. A process for preparing a high strength high toughness aluminum alloy, comprising the steps of:

heating a melt comprised of an aluminum base metal and lithium including at least 1 ppm of an alkali metal impurity selected from the group consisting of sodium, potassium, rubidium and cesium, to a temperature greater than the melting point of the alloy;

and refining the alloy in a vacuum for a sufficient time to reduce each alkali metal impurity to a concentration less than about 1.0 ppm.

2. The process of claim 1 wherein the vacuum is less than about 200 μm Hg and the temperature is about 50° to 100° C. above the melting point of the alloy.

3. A process for making a high strength, high toughness alloy, comprising the steps of:

preparing a melt under vacuum comprised of aluminum and lithium metals including a total of at least 1.0 ppm of an alkali metal impurity selected from the group consisting of sodium, potassium, rubidium and cesium; and reducing the concentration of each of the alkali metal impurity to less than about 1.0 ppm.

4. The process of claims 1 or 3, wherein the concentration of each alkali metal impurity selected from the group consisting of sodium, potassium, rubidium and cesium is reduced to less than about 0.1 ppm.

5. The process of claim 3, wherein the alloy includes a gas selected from the group consisting of less than about 0.2 ppm hydrogen and less than about 1.0 ppm chlorine.

6. The process of claim 4, wherein the alloy includes a gas selected from the group consisting of less than about 0.1 ppm hydrogen and less than about 0.5 ppm chlorine.

7. The process of claim 4 wherein the alloy further includes an alloying element selected from the group consisting of copper, magnesium, chromium, zirconium, manganese, zinc and silicon.

8. The process of claim 4 wherein the lithium concentration is in the range of about 0.5 to 4.5%.

9. The process of claim 4 further including the step of dispersing particles in the alloy to form a composite material.

10. The process of claim 9 wherein the particles are made of a material selected from the group consisting of silicon carbide, graphite, carbon, aluminum oxide or boron carbide.

11. The process of claim 4 wherein the lithium concentration is about 1.5 to 2.6%; and the alloy further includes about 1.5 to 2.5% magnesium, and about 0.05 to 0.15% zirconium.

12. The process of claim 4 wherein the lithium concentration is about 1.8 to 2.5%; and the alloy further includes about 0.5 to 1.5% magnesium; about 0.15 to 0.5% copper and about 0.1 to 0.3% chromium.

13. The process of claim 4 wherein the lithium concentration is in the range of about 2.8 to 3.8%; and the alloy further includes about 0.5 to 1.5% magnesium; and about 0.5% to 0.15% zirconium.

14. The process of claim 4 wherein the lithium concentration is in the range of about 2.8 to 3.8%; and the alloy further includes about 0.3 to 1.3% magnesium; about 0.15 to 0.5% copper and about 0.05 to 0.5% chromium.

* * * * *